US008596459B2

(12) United States Patent
Huizingh et al.

(10) Patent No.: US 8,596,459 B2
(45) Date of Patent: Dec. 3, 2013

(54) HEAVY LOAD CARRIER

(75) Inventors: Jan Abraham Huizingh, Vlagtwedde (NL); Maximus Gerardus Maria Van Der Korput, Zutphen (NL); Oliver Orset, Sainte Julie (FR)

(73) Assignee: Schoeller Arca Systems GmbH (DE)

( * ) Notice: Subject to any disclaimer, the term of this patent is extended or adjusted under 35 U.S.C. 154(b) by 0 days.

(21) Appl. No.: 13/139,977

(22) PCT Filed: Nov. 6, 2009

(86) PCT No.: PCT/EP2009/007967

§ 371 (c)(1),
(2), (4) Date: Aug. 25, 2011

(87) PCT Pub. No.: WO2010/072285

PCT Pub. Date: Jul. 1, 2010

(65) Prior Publication Data

US 2012/0031790 A1 Feb. 9, 2012

(30) Foreign Application Priority Data

Dec. 22, 2008 (DE) ..... 10 2008 064 366

(51) Int. Cl.

| | |
|---|---|
| ***B65D 19/00*** | (2006.01) |
| ***B65D 88/00*** | (2006.01) |
| ***B65D 6/00*** | (2006.01) |
| ***B65D 8/14*** | (2006.01) |

(52) U.S. Cl.
USPC ..... 206/600; 220/1.5; 220/6

(58) Field of Classification Search
USPC ..... 206/386, 600; 220/1.5, 6, 7
See application file for complete search history.

(56) References Cited

U.S. PATENT DOCUMENTS

| | | | | |
|---|---|---|---|---|
| 5,161,709 | A * | 11/1992 | Oestreich, Jr. | 220/6 |
| 5,558,241 | A * | 9/1996 | Huffstutler et al. | 220/1.5 |
| 5,601,202 | A * | 2/1997 | Meacham et al. | 220/6 |
| 5,680,948 | A | 10/1997 | Schmidt et al. | |
| 5,711,444 | A * | 1/1998 | Meacham et al. | 220/6 |
| 6,776,300 | B2 * | 8/2004 | Walsh et al. | 220/6 |
| 7,353,962 | B2 * | 4/2008 | Parnall et al. | 220/6 |
| 2008/0203089 | A1 | 8/2008 | Hartwall | |

FOREIGN PATENT DOCUMENTS

| | | |
|---|---|---|
| DE | G9203114.5 | 5/1992 |
| DE | G9405765.6 | 6/1994 |
| DE | 19601689 A1 | 7/1997 |
| DE | 10047616 | 5/2001 |
| DE | 102004012198 A1 | 9/2005 |

(Continued)

OTHER PUBLICATIONS

International Preliminary Report on Patentability for International (PCT) Patent Application No. PCT/EP2009/007967, mailed Jul. 7, 2011, 10 pages.

(Continued)

*Primary Examiner* — Byron Gehman
(74) *Attorney, Agent, or Firm* — Sheridan Ross P.C.

(57) ABSTRACT

The invention relates to a large cargo carrier (1), comprising a pallet shaped base (2), at least one side wall (4*a*), at least one first stand element (3*a*) which is at least partially made from plastic material and which is disengageably connected with the pallet shaped base (2) at an edge portion of the pallet shaped base (2), wherein the at least one side wall (4*a*) is disengageably connected with the first stand element (3*a*).

7 Claims, 3 Drawing Sheets

(56) References Cited

FOREIGN PATENT DOCUMENTS

| | | |
|---|---|---|
| EP | 0189301 A | 7/1986 |
| EP | 0690004 | 1/1996 |
| EP | 2030903 | 3/2009 |
| GB | 2333284 | 7/1999 |
| WO | WO 94/29175 | 12/1994 |
| WO | WO 95/13969 | 5/1995 |
| WO | WO 01/62610 | 8/2001 |

OTHER PUBLICATIONS

International Search Report prepared by the European International Searching Authority on Jan. 1, 2010, for International Application No. PCT/EP2009/007967.

* cited by examiner

HEAVY LOAD CARRIER

FIELD OF THE INVENTION

The invention relates to a large cargo carrier for receiving and transporting goods and other bulk material and to a kit with a plurality of stand elements.

So far, Europe pallets and industrial pallets, in particular Euro-pool pallets, colloquially designated Euro-pallets are being used for transporting goods. The disadvantage of these pallets is that they are not suitable for transporting loose bulk material since they are configured flat and do not include lateral defining walls.

Thus, for transporting loose bulk material, large cargo carriers are being used, whose basic shape is pallet shaped. Furthermore, large cargo carriers are available with dimensions that are similar to the dimensions of the pallets recited supra. The advantage of the large carriers over the pallets is that they can be used for transporting loose bulk material due to their sidewalls. However, the known large cargo carriers have the disadvantage that their plate shaped base is fixated to sidewalls that always fit precisely, this means the sidewalls are not disengageable from the base. A flexible use of the pallet shaped base without sidewalls is not possible. Another disadvantage is that the known large cargo carriers have rather large dimensions in non-filled state due to the fixed connection of the pallet shaped base with the sidewall. Even when the sidewalls are configured foldable, they require large storage space.

DESCRIPTION OF THE INVENTION

Thus, it is an object of the invention to provide a large cargo carrier which facilitates a flexible connection of the sidewalls at a pallet shaped base or at pallet shaped bases with different sizes.

The object is achieved through features of the independent patent claims. Preferred embodiments of the invention are characterized by the features of the dependent claims.

A first embodiment of the invention is characterized by a large cargo carrier with a pallet shaped base and at least one sidewall. The large cargo carrier is furthermore characterized by at least one stand element which is at least partially made from plastic material. The stand element is connected in a disengageable manner with the pallet shaped base in an edge portion of the pallet shaped base, wherein the at least one sidewall is disengageably connected with the base element.

Using a stand element which on the one hand is connected in a disengageable manner with the pallet shaped base and on the other hand connected in a disengageable manner with the at least one side wall has the advantage that a flexible connection of the side walls at a pallet shaped base is facilitated. The option of flexible handling yields the decisive advantage that new pallet shaped bases with different sizes, but also pallet shaped bases which are currently being used can be connected with accordingly configured side walls through stand elements. Thus conventional pallets, e.g. made from wood or plastic material can be used. Additional time, expense and engineering effort for producing large cargo carriers with side walls can be avoided. The use of pallet shaped bases can be adapted to the field of application. When large pieces are being transported the pallet shaped base suffices. When small bulk material has to be transported the side walls can be adapted through stand elements. Furthermore, the geometry of the stand elements and the geometry of the side walls can be adapted in a simple manner to the dimensions of pallets that are currently being used and also to the dimensions of newly developed pallets and the geometry of the stand elements can be adapted to the respective application. The disengageable connection between the at least one side wall, the stand element and the pallet shaped base yields the additional advantage that the pallet shaped bases can be stacked on one another in a space saving manner.

Overall flexible handling is facilitated by using the stand elements with the disengageable connection.

In another preferred embodiment of the cargo carrier the side wall is connected with the stand element through a linkage or a hinge. For the preferred embodiments the stand elements can be connected to the pallet base through nails, pins or bolts, but they can also be connected through clamped or stapled connections. This embodiment is also suitable in particular for wood pallets and in particular for plastic pallets or large cargo carriers. The nails or pins or bolts can thus me made from metal or plastic material or another material. The connection of the side wall through a linkage or a hinge to the stand element has the advantage that the linkage or the hinge facilitates folding the side wall in a preliminary manner towards the pallet shaped base in order to facilitate simplified loading or unloading. Furthermore simple engaging or disengaging of the side wall is facilitated through a suitable configuration of the connection. Connecting the stand element to the plate shaped base through a clamped connection has the advantage that the stand element can be connected through the stapled connection with conventional pallet shaped bases which are already being used, e.g. Euro pallets, in a particularly simple manner. This helps to avoid engineering complexity and expense. Rather the advantage can be achieved through simple application of the stand element on conventional bases that side walls can be adapted to conventional pallet shaped bases.

In another preferred embodiment the large cargo carrier includes plural stand elements disengageably connected with one another, in particular stand elements with at least two different shapes. Preferably stands can be formed by suitable combinations of plural stand elements, wherein the stands fit on pallets shaped bases with different sizes. It is preferred in particular when the stand elements are configured, so that stands can be formed through suitable combination of plural stand elements, wherein the stands fit on plate shaped bases of pallets with sizes of 800×600 mm, 1200×800 mm or 1200×1000 mm. The multi piece configuration of the stand elements yields the advantage that the stand elements can be adapted to any base or pallet sizes through arbitrary combination. Therefore no particular stand elements have to be produced for each pallet size. Rather it can be facilitated through a smart choice of the size and arrangement of the stand elements that a plurality of dimensions and thus adaptability to different pallet shaped bases is facilitated. Conventionally pallet shaped bases e.g. configured in sizes of 800 mm, 1200 mm etc. can be used. Furthermore the multi piece configuration of the stand elements helps to prevent additional engineering effort and expense since a flexible adaptation to different base sizes is facilitated. Furthermore production costs is reduced since only a limited number of components is required to be able to outfit a multitude of pallet shaped bases. Another advantage of using plural stand elements and side walls is that particular side walls can be mounted or removed in a preliminary or permanent manner e.g. for simple loading and unloading of the large cargo carrier.

In another preferred embodiment of the invention the stand elements form a preferably continuously circumferential stand frame. This preferably provides that continuously circumferential side walls enclose the pallet shaped base which is configured by the continuously circumferential stand frame.

In another preferred embodiment of the large cargo carrier the stand elements are connected with one another through a form locked connection in particular with a groove and tongue connection and/or a dove tail connection. This yields the advantage that the stand elements can be connected with one another through a form locked connection which can be produced in a simple and cost effective manner.

In another preferred embodiment the large cargo carrier includes a first and a second stand element which are preferably essentially configured mirror symmetrical. The mirror symmetrical configuration of the stand elements facilitates their application with low expense and engineering effort.

In a preferred embodiment of the large cargo carrier two first stand elements and two second stand elements are disposed in a corner portion of the rectangular pallet shaped base. The arrangement of the two first and second stand elements facilitates a complete envelopment of the pallet shaped base in a simple manner. This yields the additional advantage that the stand elements can be configured stackable in loose condition which facilitates transporting them in a space saving manner.

In another preferred embodiment of the large cargo carrier the large cargo carrier includes third stand elements which are disposed on two opposite edges of the plate shaped base between the first and the second stand elements. This yields the advantage that the stand elements or the stands can be adapted to different sizes of the plate shaped bases through inserting the third stand elements.

In a particularly preferred embodiment the third stand elements have a different height than the first and second stand elements. Thus, side walls with different sizes can be used in order to eventually produce a uniform upper termination edge which is offset from the base. It is preferable in particular that the stand elements are adapted, so that they can be combined with foldable side walls, wherein the equal heights of the stand elements are preferred on two respective opposite sides of the base, wherein the heights, however, differ for adjacent sides. This means that the base includes two opposite higher stand formations formed from higher stand elements and two opposite sides with stand formations formed from lower stand elements. This has the advantage that the side elements are respectively stacked over one another when folding the side walls over one another or when folding the side walls in, so that the side walls are supported on the base of the large cargo carrier. Furthermore embodiments with respectively different height sides, as described in the last sentence in combination with foldable side walls are features of a completed large cargo carrier according to the invention.

According to a second aspect the invention is characterized by a kit with a plurality of stand elements that are disengageable from one another, wherein the stand elements are at least partially made from plastic material and which are configured for disengageable connection at an edge portion of a plate shaped base, so that they form a preferably completely circumferential stand in the edge portion of the plate shaped base, wherein at least one wall portion is attached at the stand elements. Thus, it is achieved in a particularly preferred manner that a kit is provided through a particular selection of the stand elements, wherein the kit can be adapted to a pallet shaped base which is defined with respect to its size. This facilitates a particularly quick and efficient handling.

In another preferred embodiment of the kit the stand elements are connectable with one another through a form locked connection, in particular a groove and tongue connection and/or a dove tail connection. This yields the advantage that the stand elements are connectable with one another through simple and low production costs form locked connections.

In another preferred embodiment of the kit the stand elements include two first stand elements and two second stand elements which are respectively configured for mounting at one of the corners of the pallet shaped base.

By arranging the two first stand elements and the two second stand elements a complete envelopment of the pallet shaped base can be facilitated in a simple manner. The first and the second stand elements preferably differ with respect to the configuration of the connection elements like groove and tongue for connecting the stand elements with adjacent stand elements or with respect to their height extension, wherein they can be higher at one end of the stand element than at another end of the stand element. It is achieved by providing different stand elements that e.g. corners can be configured in a particular manner.

In another preferred embodiment the stand elements include third stand elements which are disposed between the first and the second stand elements in order to adapt the stand formed by the stand elements to pallet shaped bases with different sizes. This yields the advantage that the stand elements or the stand can be adapted to the different sizes of the pallet shaped bases through the third stand elements in a particularly simple manner.

BRIEF DESCRIPTION OF THE DRAWINGS

Other advantages and variations of the invention are subsequently described based on embodiments with reference to drawing figures wherein.

Elements with like configuration or function are designated with like reference numerals in all figures.

DESCRIPTION OF PREFERRED EMBODIMENTS

Figure 1:
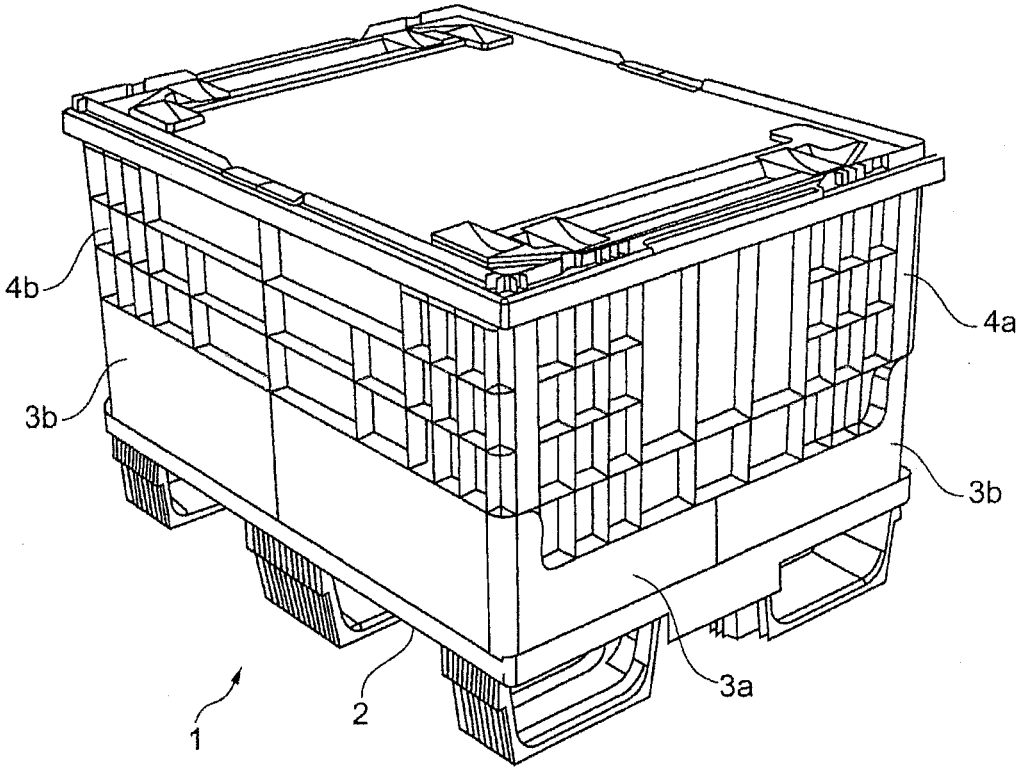
FIG. 1 illustrates a large cargo carrier according to the invention with a pallet shaped base, stand elements and side walls.

FIG. 1 illustrates a large cargo carrier 1 with a pallet shaped base 2. The pallet shaped base 2 is connected through two first stand elements 3*a* and two second stand elements 3*b* with side walls 4*a, b*. Only one of the first stand elements 3*a* is visible in FIG. 1, since the other is disposed on the backside of the large cargo carrier 1.

The two first and second stand elements 3*a, b* disengageably connected with one another are disposed in the corner portion of the rectangular base plate 2. The stand elements 3*a, b* have different heights on their respective sides which facilitates using side walls 4*a, b* with different sizes and heights in order to eventually establish a uniform upper termination edge which is offset from the plate shaped base 2.

The configuration of different heights of the stand elements 3*a, b* and also of the side walls 4*a, b* can be a suitable means to facilitate specific size adaptations which become necessary e.g. in order to receive or attach suitable bulk material. A height adaptation can also be useful in case side walls 4*a, b* with different sizes shall be used.

The stand illustrated in FIG. 1 is also a circumferential stand frame. Thus, it is achieved to provide a large cargo carrier 1 which is configured to receive loose bulk material in order to transport it in a container thus closed. The closed container is provided by applying a suitable cover.

The pallet shaped base 2 and also the stand elements 3*a, b* and the side walls 4*a, b* are made from plastic material. However, for other embodiments also other materials like e.g. metal, aluminum, wood composite materials can be used in addition to plastic material. Overall the material use and the material requirements are determined by the application, wherein the use of plastic material has particular weight advantages and also a particular robustness with respect to environmental impacts like wetness, temperature etc.

The side walls 4*a, b* are disengageably connected through a linkage with the stand elements 3*a, b* and the stand elements 3*a, b* are disengageably connected through a clamped connection with the plate shaped base 2. Additionally also other connection elements or connection mechanisms are used in preferred embodiments like groove connections, bolt connections threaded connections etc. which facilitate establishing a disengageable connection between the side walls 4*a, b* and the stand element 3*a, b* or between the stand elements 3*a, b* and the pallet shaped base 2. Clamped connections are connections which are established through clamps, wherein the clamps can have different shapes and configurations. For example a simple clamp connection can be established in that a clamp is applied from the pallet shape base 2 or from the sides of the stand elements 3*a, b*, so that the clamp is disposed in one of the recited elements and engages the respective other element. Besides the clamp connections also other connection options like e.g. riveted connections, plug in connections, threaded connections etc. are conceivable which facilitate a disengageable connection between the plate shaped base 2 and the stand elements 3*a*, 3*b*.

The side walls 4*a, b* can have identical dimensions. In alternative embodiments they can also have dimensions which differ from one another and can thus be adjusted to different size requirements in an optimum manger. Furthermore the side walls 4*a, b* can be integrally configured in one piece or configured in several pieces.

The pallet shaped base 2 and also the side walls 4*a, b* can be produced with a closed surface and also with recesses. When small size bulk material shall be transported a closed surface is preferred. When transporting large size bulk material recesses in the plate shaped base 2 or the side walls 4*a, b* can be applied in order to save weight.

Figure 2:
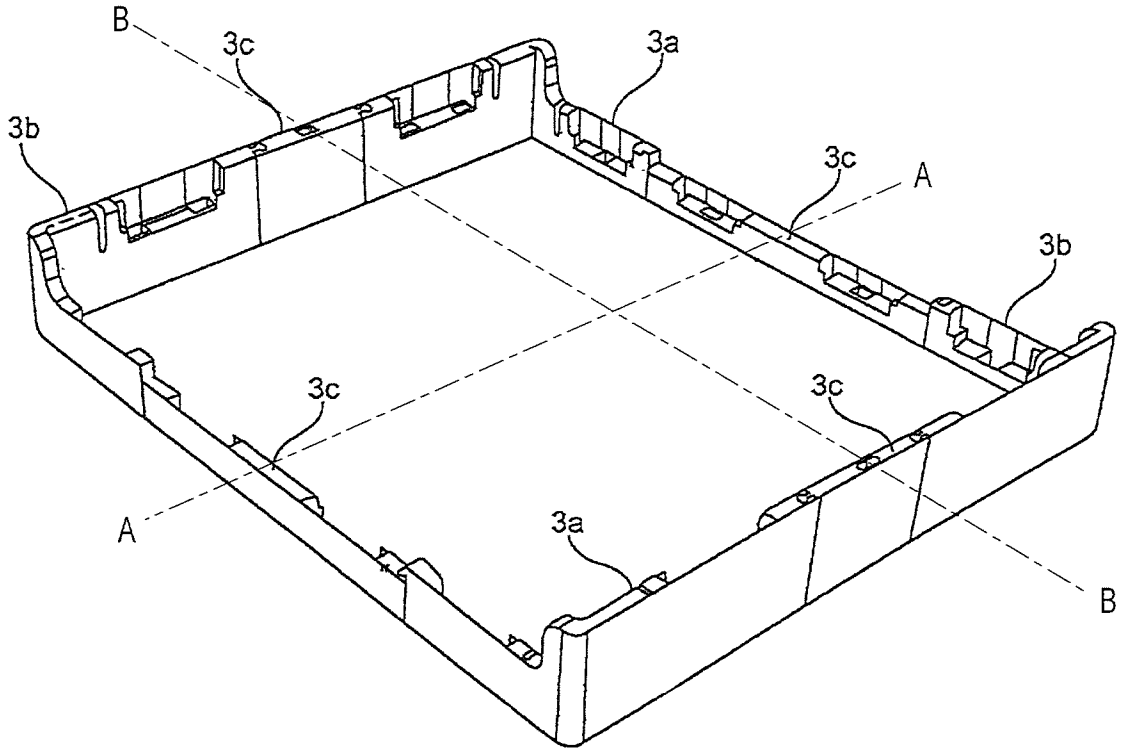
FIG. 2 illustrates a kit according to the invention including stand elements.

FIG. 2 illustrates a kit with two first stand elements 3*a*, two second stand elements 3*b* and four third stand elements 3*c*. The stand elements 3*a*, 3*b*, 3*c* are connected to one another in a disengageable manner. The third stand elements 3*c* can be used in different dimensions and are preferably disposed between the first and the second stand elements 3*a*, 3*b*. This facilitates simple size adaptation and handling. Furthermore the stand elements are configured for a disengageable connection with the plate shaped base 2 and the side wall 4*a, b*. The stand elements 3*a*, 3*b*, and 3*c* can be disposed in preferred embodiments at an edge portion of the pallet shaped base 2, so that they can form a stand which is preferably completely circumferential in an edge portion of the pallet shaped base 2. It is conceivable in an alternative embodiment to dispose particular stand elements by themselves or in combination at any position on the pallet shaped base of a large cargo carrier 1. The stand elements are connected to one another in a disengageable manner. As illustrated in FIG. 2 groove and tongue connections are preferably used herein and/or dove tail connections. However, also plug in or groove connections etc. are conceivable.

Figure 3:
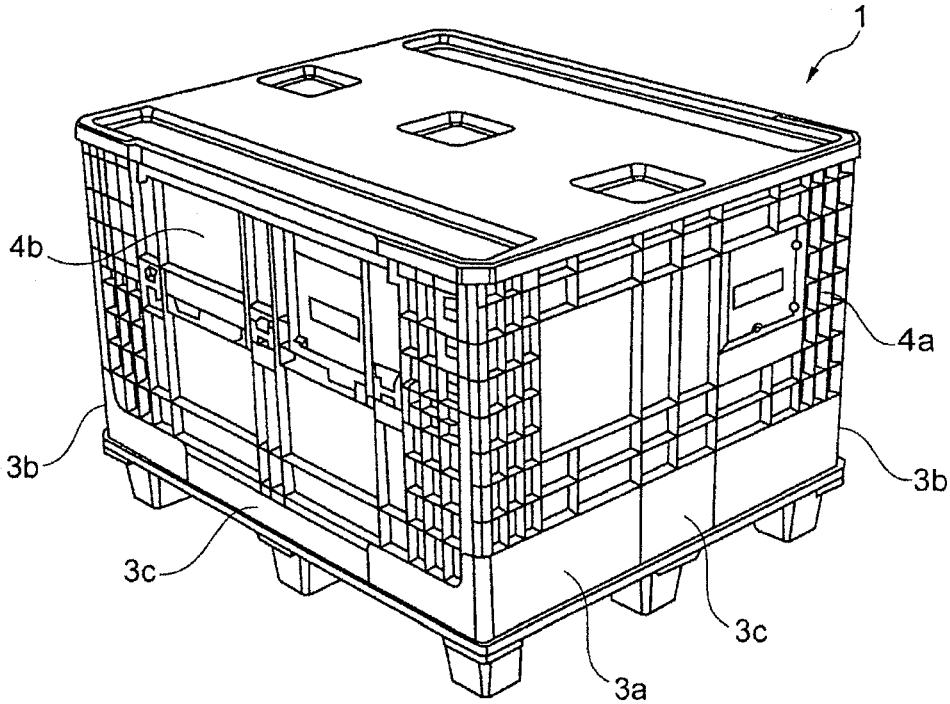
FIG. 3 illustrates another large cargo carrier according to the invention with a pallet shaped base, stand elements and side walls.

FIG. 3 illustrates a large cargo carrier which includes third stand elements 3*c* on each side in addition to the two first and the two second stand elements 3*a, b*, wherein the third stand elements 3*c* are respectively connected in a disengageable manner with the two first and the two second stand elements 3*a*, 3*b*. The respective stand elements are configured differently from one another, so that the third stand element 3*c* has a different height than the second stand element 3*b*. The second stand element 3*b* has a different height on one side than on the other side, wherein the shape of all stand elements 3*a*, 3*b* and 3*c* can be freely selected in principle. This facilitates an optimum adaptation to size requirements. The same applies also for the side walls 4*a, b* and the plate shaped base 2.

Figure 4:
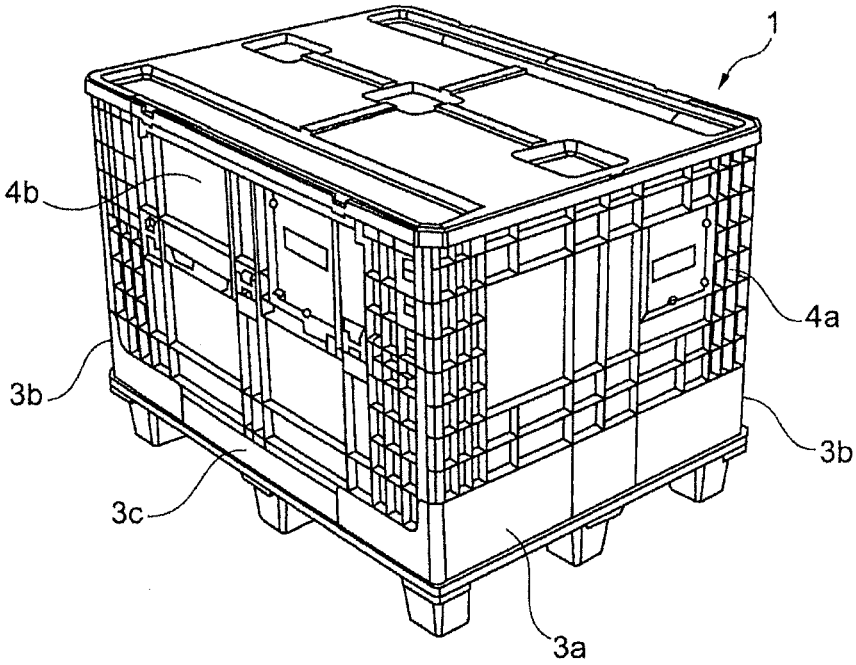
FIG. 4 illustrates another large cargo carrier according to the invention with a pallet shaped base, stand elements and side wall.

FIG. 4 illustrates another large cargo carrier 1 which includes third stand elements 3*c* only on two opposite sides in addition to the two first and two second stand elements 3*a*, 3*b*, wherein the third stand elements 3*c* are respectively disengageably connected with the two first and the two second stand elements 3*a*, 3*b*. This way a large cargo carrier can be configured with another dimension than the stand illustrated in FIG. 3.

Through a suitable selection of the third, the second and the first stand elements 3*a*, 3*b*, 3*c* an optimum size adaptation of the stand frame can be performed with respect to the pallet shaped base 2. Though typically pallet shaped bases in sizes of 900 mm and 1200 mm are being used, it is generally appreciated that the large cargo carrier 1 according to the invention is not only a large cargo carrier with larger dimensions. The large cargo carrier according to the invention can rather be a cargo carrier with very small dimensions or also a cargo carrier with very large dimensions.

FIG. 1 and also FIG. 3 illustrate large cargo carriers with a completely circumferential stand frame and stand elements 3*a*, 3*b* disposed in a corner portion. It is also conceivable that the stand frame is only configured on one side of the pallet shaped base 2 or on two sides in order to facilitate securing the bulk material to be transported in a particular manner.

The invention claimed is:

1. A large cargo carrier, comprising a rectangular pallet shaped base and circumferentially disposed side walls which are connected to the base through stand elements made of plastic material, wherein the side walls are disengageably connected to the stand elements and the stand elements are disengageably connected to the base, wherein the stand elements include two first stand elements and two second stand elements disposed in edge portions of the pallet shaped base, wherein said first stand elements and second stand elements have different heights and are at least partially constructed from plastic material, said first stand elements being mirror symmetrical to each other and said two second stand elements being mirror symmetrical to each other.

2. The large cargo carrier according to claim 1, wherein said first stand elements are connected with the pallet shaped base through one of nails, pins or bolts constructed from metal or plastic material, or through clamp connections.

3. The large cargo carrier according to claim 1, wherein the pallet shaped base is connected with the two first stand elements through a clamp connection.

4. The large cargo carrier according to claim 3, wherein the stand elements form a completely circumferential stand frame.

5. The large cargo carrier according to claim 4, wherein the first stand elements are disengageably connected among one another through a form locked connection selected from the group consisting of a groove and tongue connection and a dove-tail connection.

6. The large cargo carrier according to claim 1, wherein third stand elements are disposed on two opposite edges of the pallet shaped base between the first stand elements and the second stand elements.

7. The large cargo carrier according to claim 6, wherein the third stand elements have a different height than the first stand elements and the second stand elements.

* * * * *